US005357712A

United States Patent [19]

Streeter

[11] Patent Number: 5,357,712

[45] Date of Patent: Oct. 25, 1994

[54] ADJUSTABLE SCREEN HAVING MAGNETICALLY LATCHING LOUVERS

[76] Inventor: Edward C. Streeter, 89 Park Place, Park Parade, Harrogate, North Yorkshire HG1 5NS, United Kingdom

[21] Appl. No.: 55,184

[22] Filed: Apr. 30, 1993

[51] Int. Cl.[5] ..... E06B 7/08

[52] U.S. Cl. ..... 49/92.1; 49/74.1

[58] Field of Search ..... 49/74.1, 82.1, 86.1, 49/89.1, 90.1, 92.1, 91.1; 454/221, 224, 278; 160/236, 178.1, 107

[56] References Cited

U.S. PATENT DOCUMENTS 3,211,264 10/1965 Streeter .
3,524,281 8/1970 Streeter .
3,742,648 7/1973 Streeter, Jr. .
4,593,218 6/1986 Streeter .
4,684,911 8/1987 Streeter .
4,754,182 6/1988 Streeter .
4,797,591 1/1989 Streeter .

FOREIGN PATENT DOCUMENTS 1063707 3/1967 United Kingdom ..... 160/107

*Primary Examiner*—Peter M. Cuomo
*Assistant Examiner*—Jerry Redman
*Attorney, Agent, or Firm*—Galgano & Burke

[57] ABSTRACT

An electromagnetically operated screen having a plurality of louvers which are provided with permanent magnets for maintaining the louvers latched shut when in a closed attitude without the consumption of energy.

4 Claims, 4 Drawing Sheets

ADJUSTABLE SCREEN HAVING MAGNETICALLY LATCHING LOUVERS

BACKGROUND OF THE INVENTION

1. Field of the Invention

This invention relates to remotely adjustable screens and particularly concerns screens having louvers attached to permanent magnet rotors that are controlled by direct electromagnetic fields.

2. Description of the Prior Art

U.S. Pat. No. 3,524,281 dated Aug. 18, 1970 discloses a screen having ribbon-like louvers supported only at their ends, each end being attached to a separate permanent magnet rotor. The louver attitude is determined, except at open and closed louver limits, by equilibrium between a control torque produced by a transverse electromagnetic field and a restoring torque that tends to maintain each rotor at a predetermined angle of repose. The transverse control field is created by elongated coils, one or a pair on opposite edges of the screen, extending the length of the beams that contain the permanent magnet rotors.

Unfortunately the potential of the prior invention is obscured by the complexity of the illustrated embodiment and its obvious unsuitability for manufacture. Radical simplification of the original design has subsequently been made. For example, sturdy, inexpensive anticlastic suspensions of the rotors are described in U.S. Pat. No. 4,797,591 dated Jan. 10, 1989.

SUMMARY OF THE INVENTION

Among the objects of the invention are further improvement of the electromagnetically operated screen by minimizing the slits between overlapping closed louvers to increase thermal insulation efficiency and darken the indoors space more effectively. It is also desired to maintain the tightly closed attitude of the louvers without any energy consumption. The angular limits of louver attitudes should be extended to permit satisfactory operation of screens that have louvers rotatable about vertical axes.

These objects are attained in an electromagnetically operated screen having a plurality of louvers that are supported at their ends by terminals turnable about transversely spaced coplanar axes. A permanent magnetic pole is established near each transverse edge of every louver terminal,a north pole on one side of the rotational axis and a south pole on the diametrically opposite side. The poles near corresponding edges of adjacent terminals have the same polarity and tend to repel each other. However, the poles near the overlapping edges of adjacent terminals when the louvers are almost closed have opposite polarity and attract the terminals into latching contact.

The louvers remain latched closed without requiring any control torque until a pulse of reverse current is applied to the control coil to produce a torque on the permanent magnet rotors sufficient to overcome the latching condition. This unlatching torque permits the restoring torque to reassert control over the rotors.

The corresponding magnets on adjacent louver terminals repel each other and tend to maintain a constant equidistance at all attitudes of the louvers. Any lack of parallelism unbalances the forces of repulsion and produces a corrective torque that varies cosinusoidally with louver attitude.

The latching action of the louvers makes practicable an increase in the maximum louver angle, where previously control and restoring torques were insufficient to provide adequate alignment of louvers at a predetermined extreme attitude.

DETAILED DESCRIPTION

The theory of magnetically latching louvers is most easily understood by considering the louver terminals apart from other components of the screen in which they operate.

Figure 1:
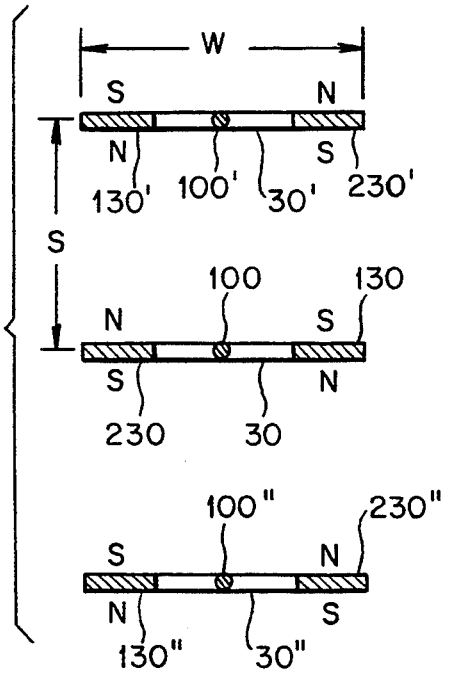
FIG. 1 is a schematic of pairs of latching magnets that are supported on louver terminals, which are shown in cross section perpendicular to their coplanar rotational axes, and reveals the relative polarization of the magnets.
Figure 2:
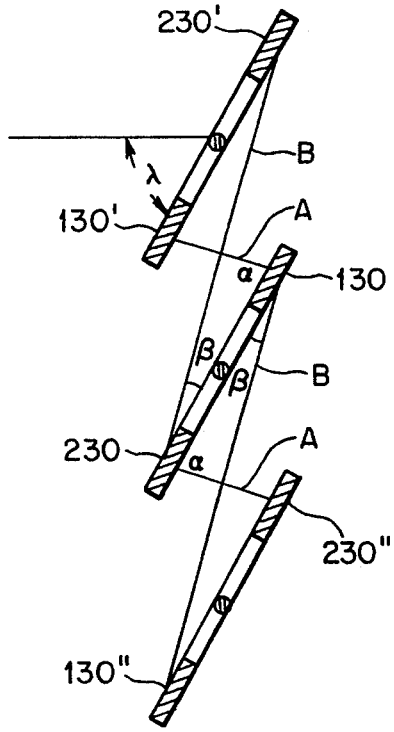
FIG. 2 shows the louver terminals of FIG. 1 inclined at an acute angle to the common plane of the rotational axes and furthers an understanding of the latching action.
Figure 3:
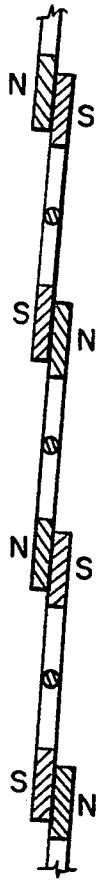
FIG. 3 shows the louver terminals of FIG. 1 in a magnetically latched closed attitude.

FIGS. 1-3 show cross sections of simplified louver terminals 30, 30' and 30'' perpendicular to coplanar rotational axes 100, 100' and 100'', respectively. The width w of each louver and its supporting terminal is greater than the spacing s between adjacent rotational axes. Accordingly, the terminals overlap an amount w-s in the closed attitude of the louvers, as shown in FIG. 3.

Louver terminal 30 contains a pair of thin flat magnets 130 and 230 magnetized through the thickness dimension perpendicularly to the plane of the terminal. Magnets 130 and are equidistantly spaced on opposite sides of the axis 100 and adjoin the transverse edges of the terminal. The width of the magnets is equal to or somewhat greater than the overlapping portion of the closed terminals (see FIG. 3). Magnets 130 and 230 are identical with the exception that North and South poles are interchanged.

Terminals 30' and +" contain magnets 130' and 130", respectively, identical to magnet 130 and magnets 230' and 230", respectively, identical to magnet 230. However, magnets 130' and 130" are on the same side of the common plane of the rotational axes as magnet 230, and magnets 230' and 230" lie on the other side of this plane opposite magnet 130.

Thus magnet 130 is repelled by magnets 230' and 230", and magnet 230 is repelled by magnets 130' and 130". The repulsion forces balance as long as the planes of the louver terminals remain parallel, keeping the magnets equidistant. However, the torques decrease cosinusoidally as the louvers are turned in unison from the fully open attitude of FIG. 1 because the line of action between the magnets becomes increasingly unfavorable as the louvers close.

Now referring to FIG. 2 where the louver terminals are at an angle of −60° with respect to the perpendicular to the common plane of the axes 100, 100' and 100". A rough but useful analysis of the effect of the force between magnets 130 and 130' or magnets 230 and 230" can be made by drawing a line of action A between the midpoints on opposing surfaces of the magnets. The line A makes an angle $\alpha$ with respect to the plane of the terminal 30. Likewise a line of action B extends between magnets 130 and 130" or magnets 230 and 230' and makes an angle $\beta$ with respect to terminal 30. The torque caused by attraction along line A acts in a sense of rotation about axis 100 opposite to that caused by attraction along line B.

It appears to be empirically justified to assume that the torques caused by the attractive forces are approximately inversely proportional to the distances along lines A and B and directly proportional to $\sin\alpha$ and $\sin\beta$, respectively. The difference between the opposing torques results in a latching torque $T_\lambda$, which is a function of the louver angle$\lambda$. Thus $$T_\lambda = K\left[\frac{\sin\alpha}{A} - \frac{\sin\beta}{B}\right] \quad (1)$$

where K=proportionality constant.

Figure 4:
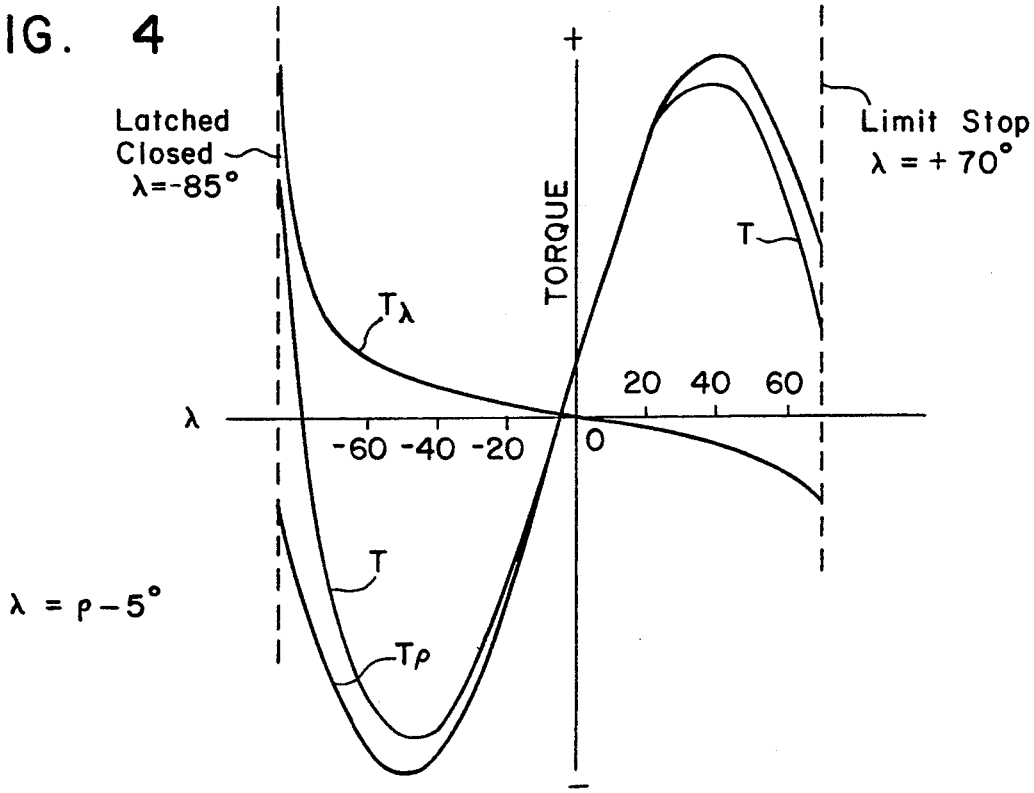
FIG. 4 comprises graphs of relative latching torque $T_\lambda$, restoring torque $T_\rho$ and the resultant torque T as functions of louver angle $\lambda$ under the condition $\lambda=\rho-5°$.

FIG. 4 shows graphs of the latching torque $T_\lambda$ in relationship to a restoring torque $T_\rho$ that tends to align the permanent magnet rotors, which operate the louvers, in the common plane of the axes of rotation.

Cited U.S. Pat. No. 3,524,281 teaches that the restoring torque is $$T_\rho = K'M^2\sin 2\rho \quad (2)$$

where

K'=a proportionality constant,

M=magnetic moment of each rotor, and $\rho$=angle of rotor magnetic axis to the common axial plane.

The restoring torque is opposed by the latching torque and gives a resultant torque T, which balances a control torque $T_c$ at equilibrium. The control torque can be expressed as $$T_c = K''iM\cos\rho \quad (3)$$

where

K"=a proportionality constant, and i=current.

The angle $\rho$ is either equal to the louver angle $\lambda$ or differs by a constant angle; consequently the restoring torque can be drawn as a function of $\lambda$ in FIG. 4.

The choice of this constant angle is guided by the need to unlatch the louver terminals by means of a negative pulse of control torque. The angle of closed louvers is limited by the thickness of the terminals to about $\lambda = -85°$, as shown in FIG. 3. Clearly, it is inconvenient at $\rho = -85°$ to generate a pulse of negative control torque sufficiently large to unlatch the louver terminals. Accordingly, the condition $\lambda = \rho - 5°$ is chosen in order to halve the necessary control current pulse. This choice does not noticeably alter the open appearance of a quiescent screen.

The proportionality constant K of the latching torque shown in FIG. 4 has been selected to let T=0 when $\lambda = -\lambda°$. This produces a positive torque T at $\lambda = -85°$, which causes the louver terminals to latch together.

A limit of $\lambda = +70°$ is predetermined by a fin on the louver terminal, as described with reference to FIGS. 6–9.

Figure 5:
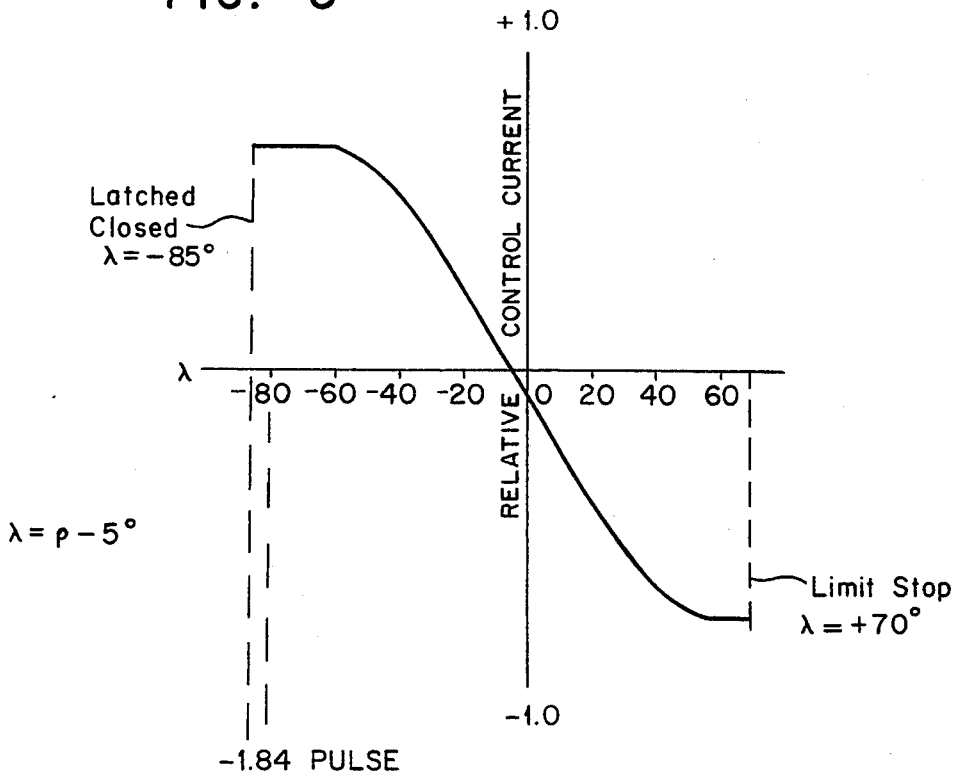
FIG. 5 is a graph of relative control current i supplied to a transverse electromagnetic field coil as a function of louver angle $\lambda$ under the torque conditions shown in FIG. 4.
Figure 6:
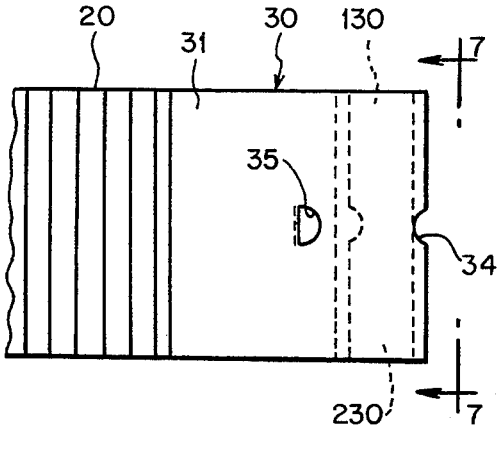
FIG. 6 is a plan of a practical louver terminal and shows its attachment to a louver.
Figure 7:
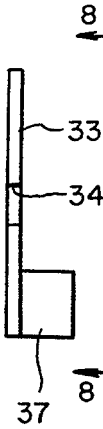
FIG. 7 shows the centerfold of the louver terminal as seen from the viewpoint of arrows 7—7 in FIG. 6.
Figure 8:
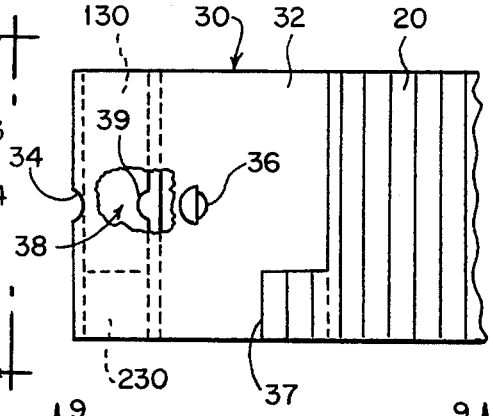
FIG. 8 is a plan of the reverse face of the louver terminal of FIG. 6 as seen from the viewpoint of arrows 8—8 in FIG. 7.
Figure 9:
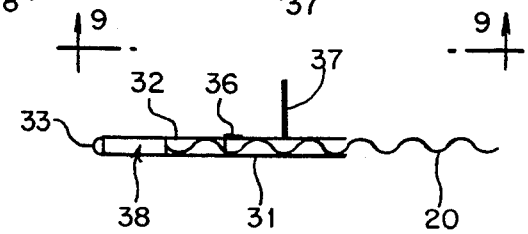
FIG. 9 shows a transverse edge of the louver terminal of FIG. 6 as seen from the viewpoint of arrows 9—9 in FIG. 8.

FIG. 5 is a graph of relative control current as a function of the louver angle. It is observed that the control is substantially linear between −45° and +45°. Beyond ±50° the torque T decreases; consequently the control torque drives the louvers to the positive and negative angular limits, respectively. The louvers return from the +70° limit shown in FIG. 5 upon reducing the control torque. However, the louver terminals are latched closed at the negative angular limit and require a pulse of negative control torque to effect their release.

This control method is seen to be suitable for louvers that rotate about vertical as well as horizontal axes with the slight inconvenience that the louvers can shut tight only in one sense of rotation.

FIGS. 6–9 show a typical louver terminal 30 formed with generally rectangular parallel wings 31 and 32 joined by a return bend or transverse centerfold 33 enclosing an end of a louver 20. A tongue 36 extends from a semicircular lancing 35 on the longitudinal centerline of wing 31 through a hole in the louver that intersects its rotational axis. The tip of tongue 36 then passes through a hole in wing 32 opposite lancing 35 and is flattened against the outside of wing 32. The tongue leaves a spacing between wings 31 and 32 that provides a sliding contact with the louver 20, which hangs on the tongue when tensioned. Sufficient clearance permits pivotal movement between louver and terminal for self-alignment with the axis of rotation. An axial hole 34 centered in the centerfold 33 provides for connection with the rotor and its suspension described with reference to FIGS. 10–13.

A louver angular limit stop in the form of a generally rectangular fin 37 projects perpendicularly from wing 32. The fin 37 extends from a transverse edge of terminal 30 partway toward the longitudinal centerline, leaving the other edge of the terminal free to make latching contact with an adjacent overlapping terminal. The fin 37 is perpendicular to the rotational axis; consequently it negligibly obstructs outward vision through a screen. On the other hand, the louver attitude is limited to a maximum positive angle $\lambda_m$ by mechanical interference with the adjacent louver terminal. Thus $$\lambda_m = \cos^{-1} d/s \quad (4)$$

where d = height of fin plus thickness of louver terminal. The fin 37 is derived by slitting and bending a portion of the free end of wing 32 without disturbing the static balance.

Magnets 130 and 230 can conveniently be formed as end portions of an integral narrow strip 38 of thin plastics-bonded barium ferrite, which is self-adhesively attached to the interior of the terminal 30 between the wings 31 and 32. The strip 38 extends from one transverse edge of the terminal to the opposite edge and lies adjacent the centerfold 33. A notch 39 is provided in the strip on the axis of rotation to serve as a guide to correct orientation of the magnetic poles.

The width of the strip 38 determines the proportionality constant K of the latching torque $T_\lambda$, and it is empirically chosen to give a resultant torque T=0 at the desired louver angle λ. Clearance between the strip 38 and the end of the louver permits sufficient pivoting about the tongue 36.

The characteristics of the louver are discussed hereinafter, but a practical louver is 20 mm wide with 16 mm spacing between rotational axes. The louver employs high strength aluminum foil 0.025 mm thick, which is corrugated transversely to give an overall thickness of 0.65 mm. A suitable louver terminal is made of aluminum 0.15 mm thick. The interior spacing between the wings 31 and 32 accomodates the strip 38, which is 0.75 mm thick and provides sliding clearance for the corrugation of the louver. In this case, the overall thickness of the louver terminal is about 1.1 mm.

DETAILS OF A SCREEN HAVING MAGNETICALLY LATCHING LOUVERS

Figure 10:
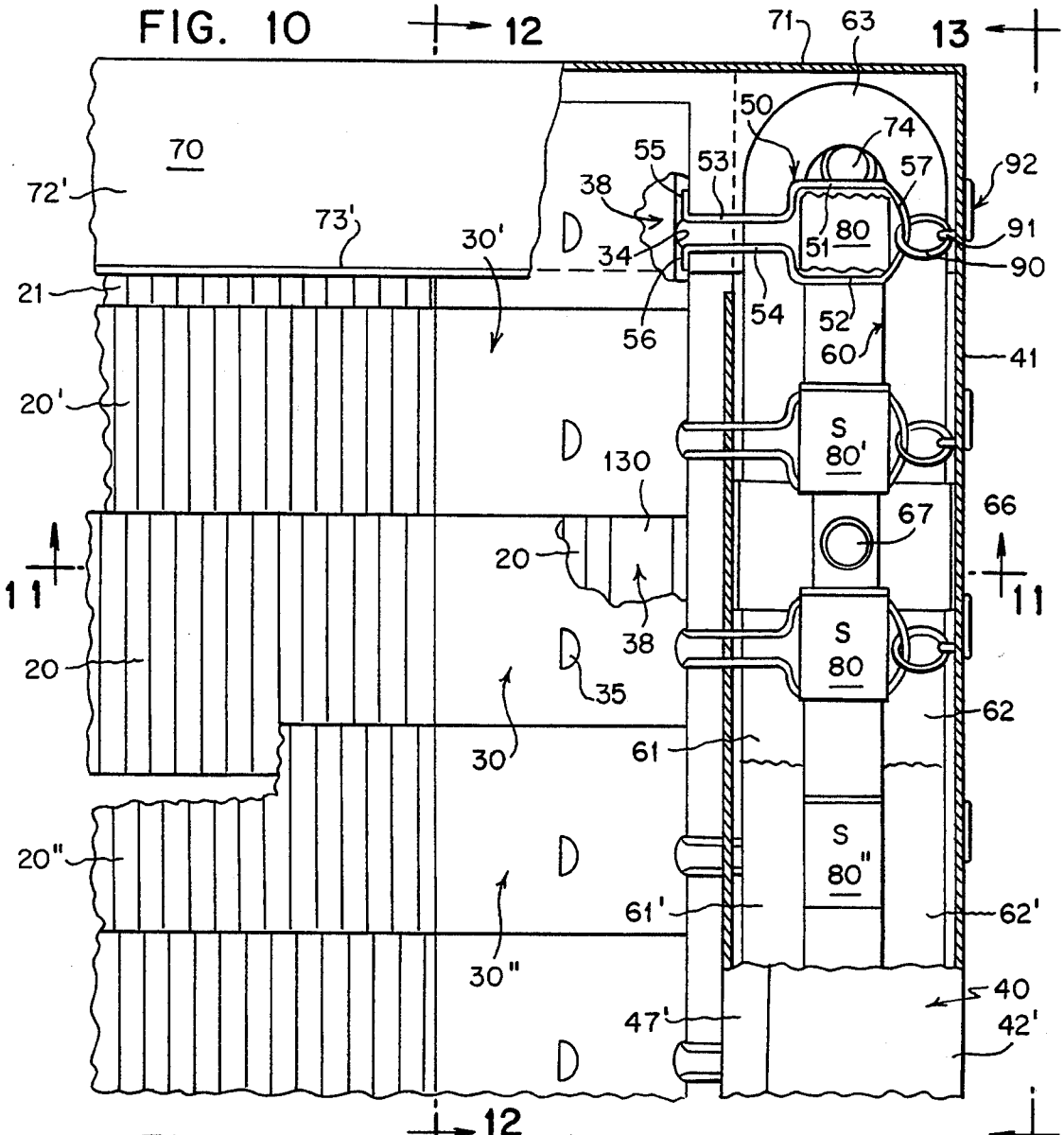
FIG. 10 is a front elevation of the upper right corner of an electromagnetically operated screen embodying the latching louvers of the present invention, with portions broken away to reveal internal construction.
Figure 11:
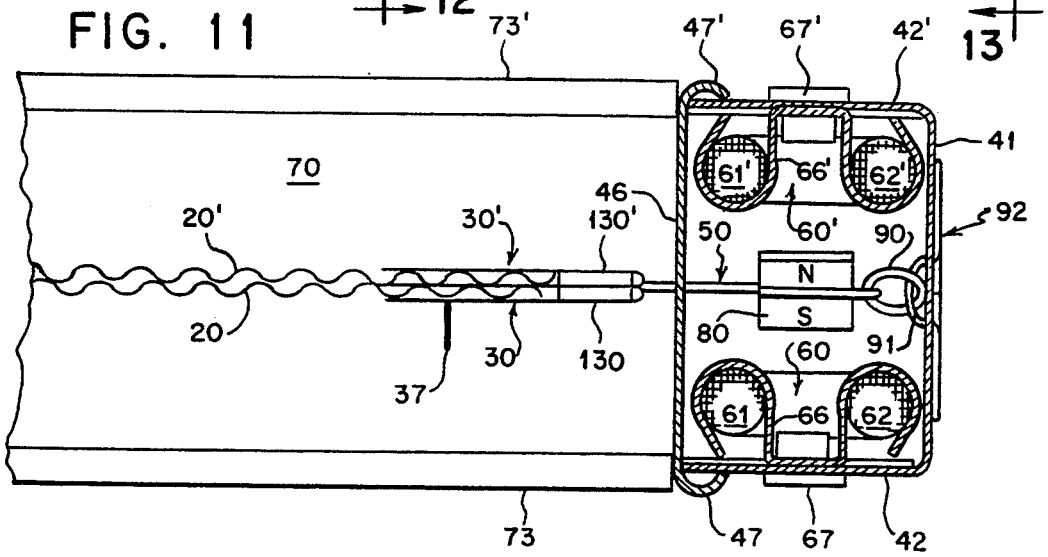
FIG. 11 is a cross section of the screen taken along the dashed line 11 of FIG. 10, showing typical louver terminals magnetically latched together.
Figure 12:
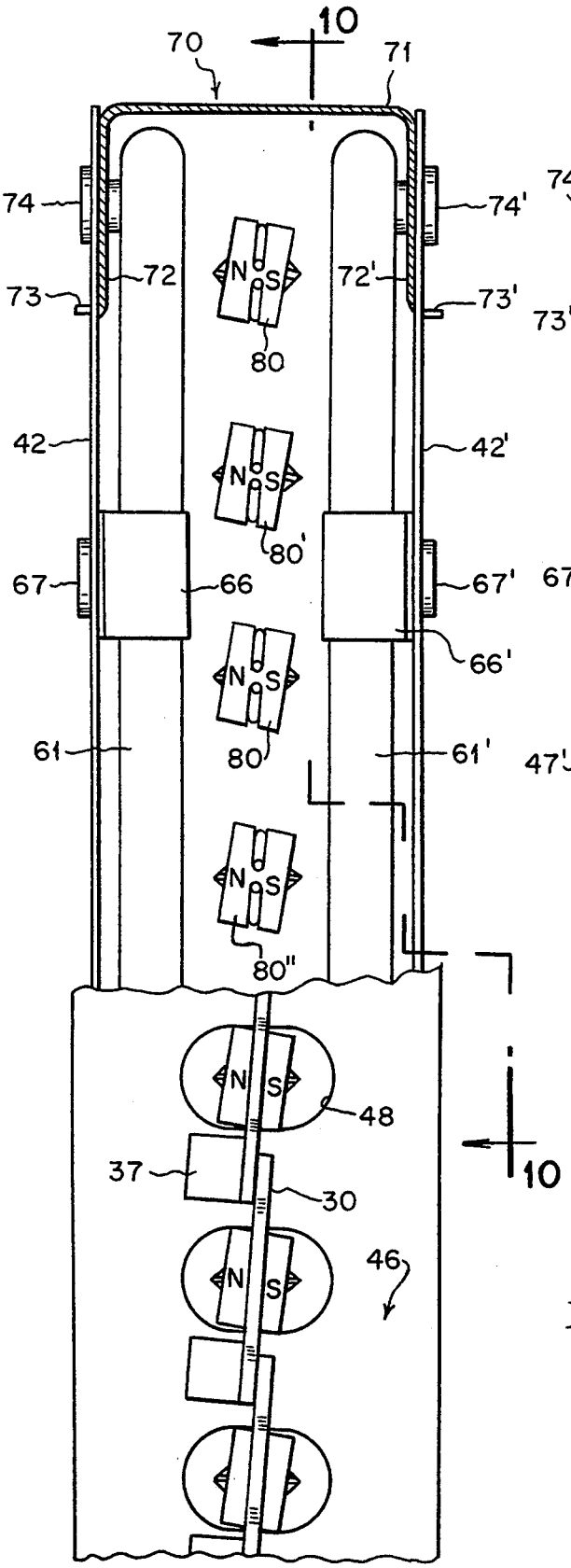
FIG. 12 is an elevational section taken along the dashed line 12—12 of FIG. 10 with several louver terminals and portions of a beam cover removed.

FIG. 10 is a front elevation of the upper right corner of an electromagnetically operated screen embodying the magnetically latching louvers. The screen comprises an array of ribbon-like louvers 20, 20′, 20″, etc. having respective louver terminals 30, 30′, 30″, etc. attached with torsional rigidity to a respective permanent magnet rotor 80, 80′, 80″, etc. mounted for rotation within a beam 40 on the right side of the screen (facing outdoors). A similar beam (not shown) is provided on the left side with corresponding louver terminals and rotors. The rotors are supported under tension for limited rotation about parallel uniformly spaced coplanar axes.

A final louver 21 is supported under equal tension at the top of the screen to serve as a light shield when the adjacent louver 20′ is closed. A corresponding initial louver (not shown) is provided for the same purpose at the bottom of the screen. A top strut 70 and a bottom strut (not shown) hold the two beams apart against the combined tensions on the louvers and complete a rectangular frame for the screen.

The beam 40 is a channel of sheet steel having a rectangular U-shaped cross section (see FIG. 11) with a base 41 and parallel sidewalls 42 and 42′. Square apertures 44 (see FIG. 13) are centered in the base 41 on the rotational axes of the louvers. A beam cover 46 (see FIG. 12) encloses the open side of the beam 40 with the exception of apertures 48, which are centered on the axes of rotation and are sufficiently large to admit the rotors 80 to the interior of the beam when suitably orientated. The cover 46 is provided with rims 47 and 47′, which overlap and grip the beam sidewalls 42 and 42′, respectively.

The strut 70 may be of either steel or aluminum and is otherwise generally similar to the beam 40 with a base 71 and parallel sidewalls 72 and 72′. However, short strengthening flanges 73 and 73′ extend perpendicularly from sidewalls 72 and 72′, respectively. The width of the strut base 71 is slightly less than that of the beam base to permit a sliding fit with the beam interior after short lengths of the flanges 73 and 73′ have been removed. The strut abuts the inner face of the beam base, and it is pinned by rivets 74 and 74′ to the sidewalls 42 and 42′, respectively.

The louvers 20 and 21 preferably comprise corrugated high-strength aluminum foil. The axes of the corrugations extend parallel to the width dimension to stiffen the louver transversely and to render it longitudinally resilient. The corrugations are formed by passing work-hardened flat foil between the engaging involute teeth of a pair of spur gears in a rapid and continuous operation. Very thin foil can be employed to maximize resilience and minimize sag of horizontally hung louvers because the screen is normally enclosed by plates of glass. The thinness of the foil permits the necessary longitudinal resilience to be obtained with corrugations so fine (much enlarged in FIG. 11) that the louver looks essentially flat and gives an extraordinarily unobstructed view when the louvers are fully open. This longitudinal resilience accomodates thermal expansion or contraction of the louvers without noticeable change in sag, and it also compensates for unavoidable variation in the spacing between the beams. A full discussion of this type of louver is found in U.S. Pat. No. 3,342,244 dated Sep. 19, 1967.

The torsionally rigid connector between a typical louver terminal 30 and its respective rotor 80 comprises a wire armature 50. The rotor associated with the louver 21 has been broken away to reveal the different portions that form the wire armature. The armature 50 has a pair of opposed portions 51 and 52 for resiliently holding the rotor. A U-bend section 57 joins the portions 51 and 52 and provides an anticlastic bearing surface, which will be discussed with reference to the suspension assembly. Generally parallel legs 53 and 54 extend from the free ends of portions 51 and 52, respectively, and terminate in studs 55 and 56, respectively, that project in opposite directions substantially perpendicularly to the axis of rotation. All portions of the armature 50 lie in a common plane, which is symmetrical about the rotational axis. The axial hole 34 in the louver terminal 30 provides the studs with access to the terminal interior. The studs lie along the foldline of the terminal with the legs 53 and 54 resiliently pressing against opposite edges of the hole 34.

Figure 14:
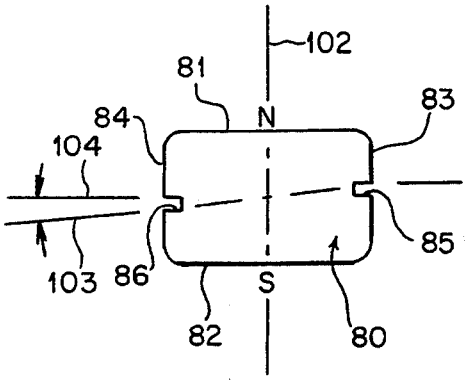
FIG. 14 is an axial view of an enlarged end of a permanent magnet rotor.

The permanent magnet rotors preferably comprise short sections of a continuous extrusion of plastics-bonded barium ferrite having a generally rectangular cross section shown in FIG. 14. A typical rotor 80 has a first pair of parallel opposite sides 81 and 82 and a second pair of parallel opposite sides 83 and 84 perpendicular to the first pair of sides. Narrow grooves 85 and 86 extend along the entire length of the sides 83 and 84, respectively, parallel to and coplanar with the central axis 101 of the rotor. Groove 85 is slightly offset from the median line toward side 81, and groove 86 is offset an equal distance from the median line toward side 82. The grooves accept the rotor holding portions 51 and 52 of the wire armature.

The rotor 80 is uniformly magnetized perpendicularly through sides 81 and 82, and FIG. 14 shows the magnetic axis 102 at $\rho=0°$ in alignment with the longitudinal axis of the beam 40. The louver attitude perpendicular to the plane of the screen frame is indicated by a line 104. The plane of the armature and thus the attitude of an attached louver is determined by a line 103 that passes through the centers of the grooves 85 and 86. In the present case, the angle between lines 104 and 103 is $-5°$, which means that the louver reposes at an attitude of $\lambda=-5°$ in the absence of any magnetic control field. The light transmitted at this attitude is negligibly less than that transmitted when $\lambda=0°$.

A self-aligning suspension assembly for the rotor is provided by an annulus 90 that links the U-shaped section 57 of the armature 50 with a U-shaped saddle 91 (see FIG. 11) formed in a wire toggle fastener 92, which is supported by the base 41 of the beam. The annulus 90 is a ring in the form of a very thin washer, which has had the edge of its hole deburred and rounded, as by shot peening. Limited rotation can take place at the contact between opposed anticlastic surfaces of the annulus 90 and the U-bend section 57 and at the contact between the annulus and the saddle 91. Previously mentioned U.S. Pat. No. 4,797,591 teaches that when the radius of convexity along a transverse plane section of each contacting surface is an order of magnitude smaller than the radius of concavity along a longitudinal plane section of the respective surface, no mechanical restoring torque arises over the operational range of rotational angles. The frictional torque at angles of $\pm 45°$ between the planes of the contacting surfaces is only twice the torque that exists when the planes are perpendicular to each other.

The rotation is shared between two pivot points; consequently the rotational angle never exceeds 45 degrees at a single point of contact. The frictional torque is minimized by employing fine round steel music wire for both the armature 50 and the toggle fastener 92. The annulus 90 can be made of high tensile strength beryllium copper.

Figure 13:
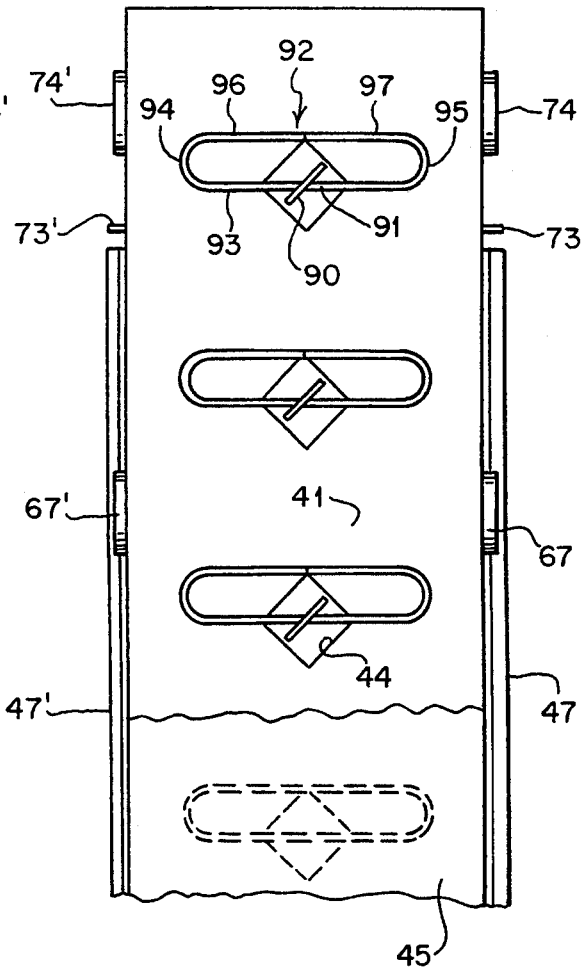
FIG. 13 is an elevation of the screen beam seen from the viewpoint of arrows 13—13 in FIG. 10.

The toggle fastener 92 provides the saddle 91 as an arcuate offset centered in an otherwise straight shank 93 connecting semicircles 94 and 95 that lie flat against the outer face of the beam base 41. End portions 96 and 97 extend from the semicircles 94 and 95, respectively, parallel to the shank 93 and mutually abut to complete an elongated oval outline for the fastener 92, as seen in FIG. 13. The saddle 91 is centered between diagonally opposite corners of the aperture 44 in the beam base 41 and projects perpendicularly to the oval outline of the toggle fastener into the interior of the beam 40.

The rotor 80 is mounted in the beam by first passing it through the aperture 48 in the cover 46 with the U-bend 57 of the armature 50 linked by the annulus 90 to one of the semicircles 94 or 95 of the toggle fastener. The clearance between the louver terminal 30 and the beam cover 46 is adequate for the toggle fastener to pass entirely through the square aperture 44 in the beam base 41 with a sufficient portion of the annulus 90 appearing on the exterior of the base to permit half the length of the shank 93 to be pushed axially across the aperture while threading the annulus. The saddle 91 reaches the annulus at the midpoint of the shank, permitting the fastener 92 to rotate 90 degrees about the axis of the shank as the saddle 91 enters the aperture 44. Thereupon the annulus is drawn by the resilience of the attached louver into its operative position, and the saddle is fixed transversely across the beam base by the diagonal corners of the aperture. Protective tape 45 covers the toggle fasteners and prevents sealant from penetrating the beam interior when the screen is eventually hermetically assembled within glass plates.

The transverse electromagnetic control field is created by energizing a pair of elongated multi-turn coils 60 and 60' that extend past all the rotors 80 in the beam and interconnect with a U-bend 63 near the top of the beam and a similar U-bend (not shown) at the other end. Coil 60' is similar to coil 60 and comprises legs 61' and 62' and a U-bend 63' The coils are supported by aluminum yokes 66 and 66', respectively, at spaced points where the yokes are secured to the sidewalls 42 and 42', respectively.

It must be pointed out with reference to magnetically latching louvers that it is only necessary to provide a first permanent magnet fixed to each louver terminal on the same side of its respective rotational axis. A complementary latching component fixed to the opposite side of each terminal axis can be a steel counterplate, although the component preferably takes the form of a second permanent magnet, as in the illustrated embodiment of the invention.

I claim:

1. An electromagnetically operated screen having a plurality of louvers turnable about transversely spaced coplanar rotational axes, said louvers being supported only at their ends by terminals, characterized by a first permanent magnet fixed to each terminal adjacent the longitudinal edges thereof on the same side of its respective rotational axis, the magnetic axis of each magnet being directed to repel the magnet on the adjacent terminal, and a complementary latching component fixed to each terminal adjacent the other longitudinal edge thereof on the opposite side of its respective rotational axis from said first magnet, the magnet on one terminal and the latching component on an adjacent terminal being located in the terminal portions that overlap in the closed attitude of the louvers.

2. A screen according to claim 1 wherein said complementary latching components comprise second magnets having magnetic axes directed in the opposite sense to said first magnets on the respective louver terminal, the magnetic axes of the corresponding magnets on adjacent terminals being directed in reverse senses, whereby magnets having the same sense of magnetism are substantially juxtaposed in the closed attitude of the louvers.

3. An electromagnetically operated screen having a plurality of louvers turnable about transversely spaced coplanar axes, said louvers being supported only at their ends by terminals, characterized by means fixed to each terminal adjacent longitudinal edges thereof for establishing a permanent magnet pole on one side of its respective rotational axis and an unlike pole on its diametrically opposite side, the poles on corresponding sides of adjacent terminals being like and mutually repellant, whereby opposite sides of adjacent terminals carry unlike poles and are mutually attractive in the overlapping closed attitude of the louvers.

4. A screen according to claim 3 wherein the means for establishing said magnetic poles comprise one pair of a series of similar pairs of flat thin permanent magnets, the magnets of said one pair being fixed to a typical louver terminal adjacent the transverse edges thereof on opposite sides of the axis of rotation and parallel to the plane of the louver, said magnets being magnetized through their thickness in opposing senses, the corresponding magnets on adjacent terminals being magnetized in the reverse senses, whereby attracting magnets on adjacent louver terminals overlap in the closed attitude of the louvers.

* * * * *